US008469003B2

(12) United States Patent
Engquist et al.

(10) Patent No.: US 8,469,003 B2
(45) Date of Patent: Jun. 25, 2013

(54) FUEL INJECTOR CLAMP

(75) Inventors: John Engquist, Saint Charles, IL (US); Richard Hennen, Saint Charles, IL (US)

(73) Assignee: Burgess • Norton Mfg. Co., Inc., Geneva, IL (US)

( * ) Notice: Subject to any disclaimer, the term of this patent is extended or adjusted under 35 U.S.C. 154(b) by 467 days.

(21) Appl. No.: 12/807,582

(22) Filed: Sep. 10, 2010

(65) Prior Publication Data

US 2012/0060797 A1 Mar. 15, 2012

(51) Int. Cl.
*F02M 61/14* (2006.01)

(52) U.S. Cl.
USPC ..... 123/470

(58) Field of Classification Search
USPC ..... 123/470
See application file for complete search history.

(56) References Cited

U.S. PATENT DOCUMENTS

| | | | | |
|---|---|---|---|---|
| 4,246,877 | A * | 1/1981 | Kennedy | 123/470 |
| 4,901,700 | A * | 2/1990 | Knight et al. | 123/470 |
| 7,063,075 | B2 * | 6/2006 | Berger et al. | 123/470 |
| 7,334,572 | B1 * | 2/2008 | Diggs et al. | 123/470 |
| 7,467,618 | B2 * | 12/2008 | Zdroik et al. | 123/470 |
| 2006/0118091 | A1 * | 6/2006 | Zdroik | 123/470 |
| 2011/0073076 | A1 * | 3/2011 | Lazich | 123/470 |

FOREIGN PATENT DOCUMENTS

JP 2012-57249 * 3/2012

* cited by examiner

*Primary Examiner* — Hai Huynh
(74) *Attorney, Agent, or Firm* — Edward J Brosius

(57) ABSTRACT

A method of forming a fuel injector clamp utilizing powder metal techniques is provided. A powder metal charge comprising in percent by weight, 0.6-0.9 carbon, 1.5-3.9 copper, 93.2-97.9 iron with the balance other elements, is die compacted to a density of 7.0-7.1 grams per cubic centimeter pre-sintered at 1500-1600 degrees Fahrenheit to form a powder metal blank. The powder metal blank is then lubricated and re-compacted to at least 7.3 grams per cubic centimeter and sintered at 2050 degrees Fahrenheit to form a final powder metal blank. The fuel injector clamp itself is comprised of a unitary structure of powder metal having a generally cylindrical center portion, with a first wing portion extending laterally there from and a second wing portion extending laterally there from at a 180 degree angle from the first wing portion.

6 Claims, 2 Drawing Sheets

FUEL INJECTOR CLAMP

BACKGROUND OF THE INVENTION

The present invention relates to a method of forming a fuel injector clamp and, more particularly, to a method of forming a fuel injector clamp using a powder metal process and to the fuel injector clamp itself.

Fuel injectors in internal combustion gasoline, diesel and other engines are often held in place by a clamping device, termed a fuel injector clamp. Such fuel injector clamps can be made from forged steel or investment castings; some fuel injector clamps are made from suitable powder metals as well. Such fuel injector clamps must be sufficiently strong and rigid to assure proper holding and sealing of the fuel injector during periods of stress.

In certain designs of fuel injector clamps, it is desirable for the fuel injector clamp to be deformable by stress or load. It is important that the fuel injector clamp be able to be deformed within elastic limits such that, the fuel injector clamp responds elastically without failure or cracking.

Accordingly, it is object of the present invention to provide an improved method for the manufacture of a fuel injector clamp utilizing powder metal methods.

It is another object of the present invention to provide an improved fuel injector clamp made of powder metal.

SUMMARY OF THE INVENTION

A method of manufacturing a fuel injector clamp utilizing powder metal techniques is provided. Such method includes a powder metal technique involving the provision of a powder metal charge comprising in percent by weight, 0.6-0.9 carbon, 1.5-3.9 copper, 93.2-97.9 iron, with the balance other elements. The powder metal charge is die compacted to a density of 7.0-7.1 grams per cubic centimeter, and then pre-sintered at 1500-1600 degrees Fahrenheit to form a powder metal blank. The powder metal blank is then coated with a suitable lubricant.

The lubricated powder metal blank is then re-compacted to density of at least 7.3 grams per cubic centimeter and then sintered at about 2050 degrees Fahrenheit to form a final powder metal blank in the desired configuration of the fuel injector clamp.

A fuel injector clamp is also provided that is comprised of a compacted sintered powder metal. The fuel injector clamp itself comprises a unitary structure having a generally cylindrical center portion itself having a center opening. A first wing portion extends laterally therefrom, and a second wing portion extends laterally therefrom at a 180 degree angle from the first wing portion. The center portion of the fuel injector clamp includes a lower surface, with a first support edge extending downwardly from the center portion lower surface adjacent the intersection with the first wing portion. A second support edge extends downwardly from the center portion lower surface adjacent the intersection with the second wing portion. The center portion lower surface extends downwardly beyond the lower limits of the first support edge and second support edge.

Upon subjecting the fuel injector clamp to a downward load at the first and second wing portions, the first and second support edges move downwardly elastically to a plane even with the center portion lower surface.

DETAILED DESCRIPTION OF THE PREFERRED EMBODIMENT

A method of forming a fuel injector clamp utilizing powder metallurgy techniques is provided. This method comprises the steps of providing a powder metal charge comprising, in percent by weight, 0.6-0.9 carbon, 1.5-3.9 copper, 93.2-97.9 iron, with the balance other elements. The powder metal charge is die compacted to the blank shape of the fuel injector clamp to a density of 7.0-7.1 grams per cubic centimeter. The compacted blank is then pre-sintered at 1500-1600 degrees Fahrenheit, for a period of 15 minutes to form a powder metal blank. This powder metal blank is then coated with suitable lubricant such as EBS-WAX (Ethylene Bi-Stearamide). The lubricated powder metal blank is re-compacted to a density of at least 7.3 grams per cubic centimeter and then sintered at about 2050 degrees Fahrenheit for a period of 10 to 30 minutes to form final powder metal blank. The final powder metal blank has a ductility and elongation to allow strain without permanent deformation of at least two percent.

Figure 1:
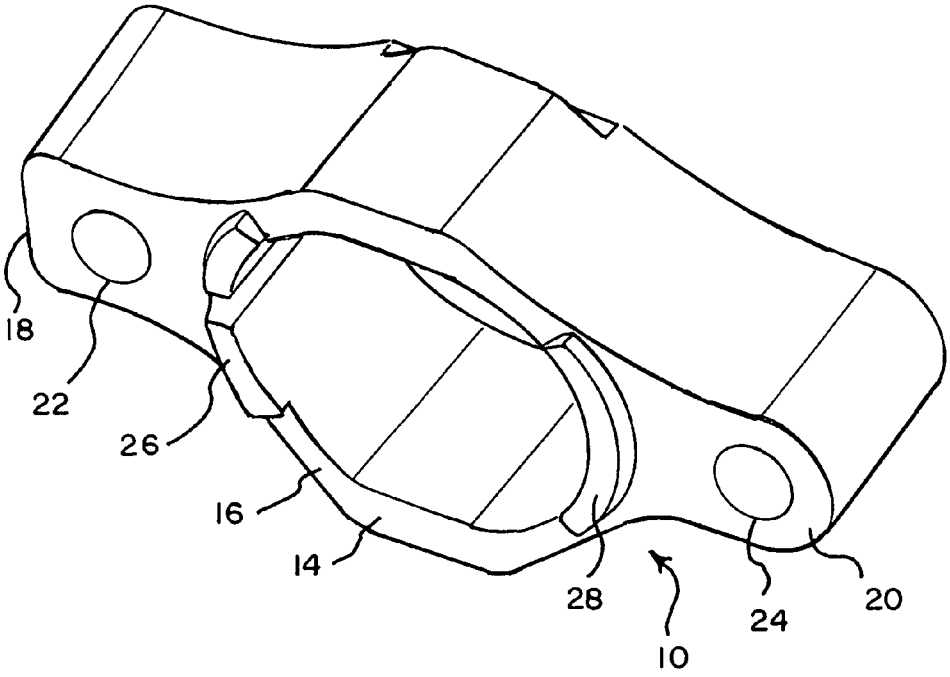
FIG. 1 is a perspective view of a fuel injector clamp in accordance with a first embodiment of the present invention.

Referring now to FIG. 1, a fuel injector clamp 10 is shown in accordance with the first embodiment of the present invention. Fuel injector clamp 10 is comprised of a powder metal made in accordance with the method described above. Fuel injector clamp 10 comprises a generally cylindrical center portion 14 having an opening axially there through. Center portion 14 includes a lower surface 16.

First wing portion 18 extents laterally from center portion 14 and includes an axial opening 22 extending vertically there through. Fuel injector clamp 10 also includes a second wing portion 20 extending laterally from center portion 14 in a direction 180 degrees from first wing portion 18. Second wing portion 20 also includes an axial opening 24 that extends vertically there through.

Center portion 14 also includes lower surface 16 that itself includes a first support edge 26 extending downwardly along a portion of lower surface 16 adjacent the intersection of first wing portion 18 and center portion 14. A second support edge 28 extends downwardly along a portion of lower surface 16 adjacent the intersection of second wing portion 20 with center portion 14.

Figure 2:
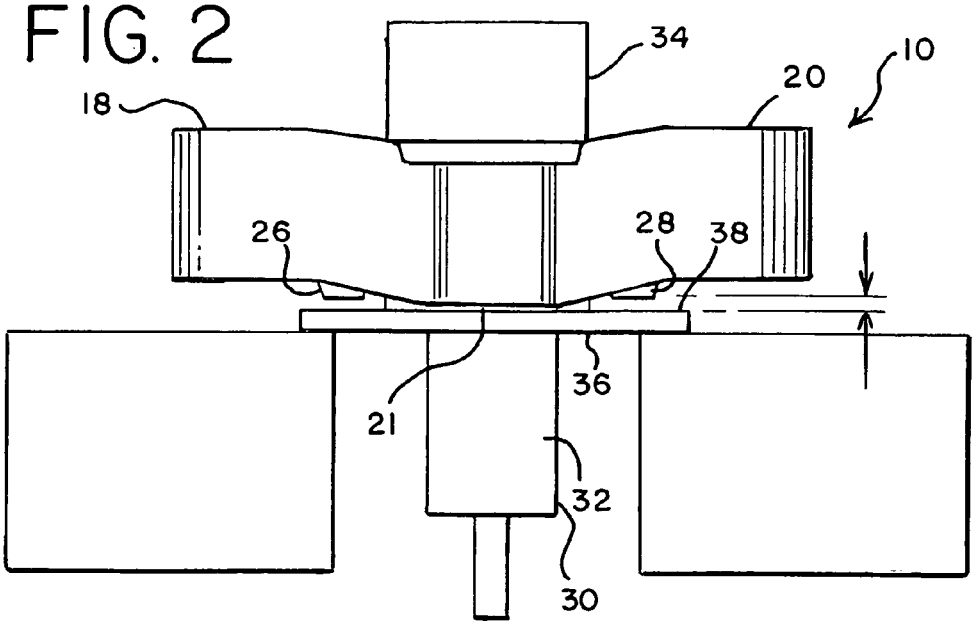
FIG. 2 is a side view of a fuel injector clamp in accordance with a first embodiment of the present invention with a fuel injector inserted in the fuel injector clamp.
Figure 3:
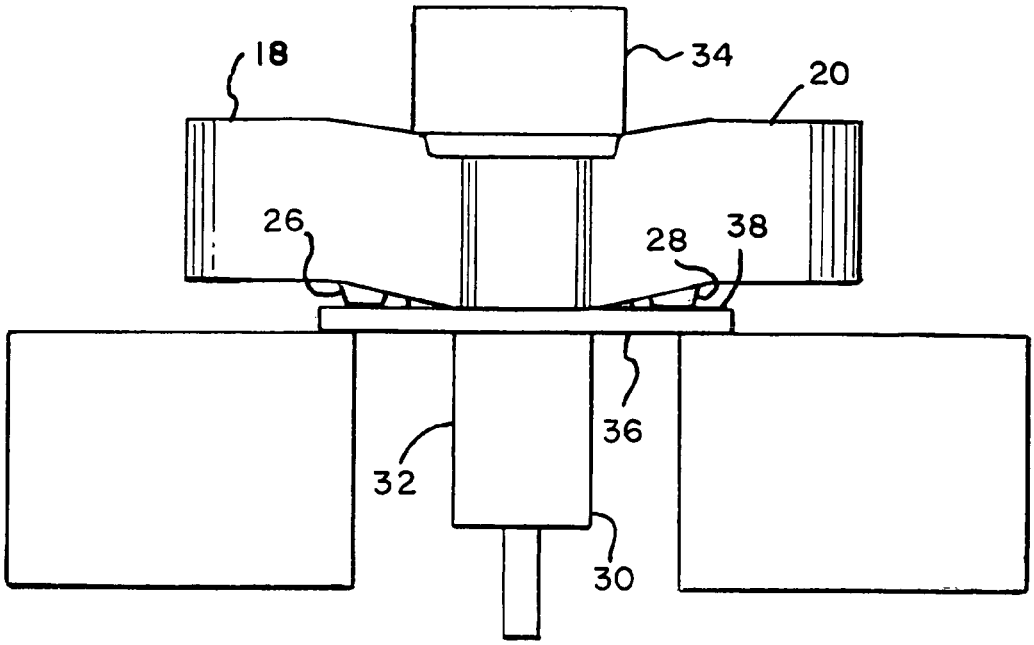
FIG. 3 is a fuel injector clamp in accordance with a first embodiment of the present invention, with a fuel injector inserted in the fuel injector clamp and wherein the fuel injector clamp is subjected to a downward load.

Referring now to FIG. 2 and FIG. 3, fuel injector clamp 20 is seen to receive fuel injector 30. Fuel injector 30 is seen to comprise a generally cylindrical elongated structure having a generally cylindrical lower body section 32, a generally cylindrical upper body section 34, and a support 36 located between lower body section 32 and upper body section 34. Upper body section 34 is seen to pass through the opening in center portion 14 of fuel injector clamp 10.

In FIG. 2, under an unloaded condition, fuel injector clamp 10 is seen to have a lower portion 21 of its center portion 14 contacting upper surface 38 of fuel injector support 36. Under a no load condition, first support edge 26 and second support edge 28 do not contact upper surface 38 of fuel injector support 36. As shown in FIG. 3, under a load condition, fuel injector clamp 10 would deform elastically such that first support edge 26 and second support edge 28 would move downwardly to engage upper surface 38 of fuel injector support 36. Such deformation under load would be elastic and, under a downward force of between 10,000 and 23,300 (2250 & 5250 Lbs) newtons, result in a downward movement of first support edge 26 and second support edge 28 each of between 0.63-1.0 milimeters (0.024-0.040 inches).

What is claimed is:

1. A fuel injector clamp comprised of a compacted, sintered powder metal comprising, by percent weight, 0.6-0.9 carbon, 1.5-3.9 copper, 93.2-97.9 iron, with the balance other elements, having a density of at least 7.3 g/cc, the fuel injector clamp comprising a unitary structure having a generally cylindrical center portion having a center opening, with a first wing portion extending laterally there from and a second wing portion extending laterally there from at a 180degree angle from the first wing portion, the center portion having a lower surface, and a first support edge extending downwardly from the center portion lower surface adjacent the first wing portion, and a second support edge extending downwardly from the center portion lower surface adjacent the second wing portion, and the center portion lower surface extending downwardly beyond the first support edge and the second support edge.

2. The fuel injector clamp of claim 1 wherein when the fuel injector clamp is subjected to a downward load at the first and second wing portions, the first and second support edges move downwardly to a plane even with the center portion lower surface.

3. The fuel injector clamp of claim 2 wherein the downward load is less than the elastic limit of the fuel injector clamp.

4. The fuel injector clamp of claim 1 wherein the fuel injector clamp is installed in an engine, and a fuel injector is placed through the center opening in the center portion of the fuel injector clamp, the fuel injector including a generally flat support having an upper surface that faces the center portion lower surface of the fuel injector clamp, wherein when the fuel injector clamp is subjected to a downward load at the first and second wing portions, the first and second support edges move elastically downward to control the fuel injector support upper surface.

5. The fuel injector clamp of claim 4 wherein the downward load is a force of between 10,000 (2250 Lbs) and 23,300 (5250 Lbs) newtons,

6. The fuel injector clamp of claim 4 wherein the first and second support edges move elastically downward a distance of between 0.63 and 1.0 mm (0.024-0.040 in).

* * * * *